United States Patent [19]

Selines et al.

[11] 4,159,217

[45] Jun. 26, 1979

[54] CRYOGENIC FORMING

[75] Inventors: Ronald J. Selines, Yorktown Heights; Jaak S. Van den Sype, Scarsdale, both of N.Y.

[73] Assignee: Union Carbide Corporation, New York, N.Y.

[21] Appl. No.: 839,293

[22] Filed: Oct. 4, 1977

Related U.S. Application Data

[63] Continuation-in-part of Ser. No. 672,367, Mar. 31, 1976, abandoned.

[51] Int. Cl.[2] ..... C22F 1/04

[52] U.S. Cl. ..... 148/11.5 A; 72/364; 72/700; 148/125

[58] Field of Search ..... 148/125, 11.5 A; 72/364, 700

[56] References Cited

U.S. PATENT DOCUMENTS

| | | | |
|---|---|---|---|
| 3,149,008 | 9/1964 | Forsberg | 148/125 |
| 3,266,946 | 8/1966 | Merlin | 148/125 |
| 3,568,491 | 3/1971 | Bruner et al. | 148/125 |

*Primary Examiner*—R. Dean

*Attorney, Agent, or Firm*—Saul R. Bresch

[57] ABSTRACT

In a method for cryogenically forming a sheet of aluminum or a solid solution strengthened aluminum alloy wherein the sheet has a maximum thickness of about 0.2 inch, said method comprising forming said sheet into a shaped article of desired configuration by deforming said sheet at a cryogenic temperature in the range of about minus 100° C. to about minus 200° C., the improvement comprising:

(a) work-hardening the sheet to at least about 25 percent of maximum hardness prior to the cryogenic deformation; and (b) conducting the cryogenic deformation in such a manner that (i) at least part of the sheet is deformed by tensile stresses, (ii) the thickness of said part is reduced by at least 2 percent by said deformation, and (iii) the smallest dimension of the area of the part to be deformed is at least equal to the thickness of the sheet.

3 Claims, No Drawings

CRYOGENIC FORMING

This application is a continuation-in-part of application Ser. No. 672,367 filed on Mar. 31, 1976, abandoned.

This invention relates to cryogenically forming work-hardened sheets of aluminum into shaped articles of desired configuration. More specifically, this invention relates to a method of forming work-hardened sheets of aluminum and aluminum alloys into shaped articles of desired configuration by deforming the metal sheets under tensile stresses at a temperature in the range of about −100° C. to about −200° C.

As a general rule, aluminum and aluminum alloys are among the most readily formable of the commonly fabricated metals. Consequently, aluminum and aluminum alloys have been extensively used in the construction, transportation and packaging industries as siding, architectural trim, panels, containers and the like. The extensive use of aluminum and aluminum alloys has been limited, however, particularly in the automotive industry, due to the fact that thin sheets of aluminum and aluminum alloys, which are used to form automobile fenders, hoods, and doors, tend to fracture, tear and/or undergo discontinuous or serrated deformation during the forming operation. Furthermore, parts made from such sheets of aluminum and aluminum alloys have been found to have poor scratch and dent resistant properties. As a result, their surfaces are easily scratched and dented becoming aesthetically unattractive. Therefore, the advantages of using more aluminum and aluminum alloys in the manufacture of automobiles, which would result in lighter, more efficient automobiles, are more than offset by problems of formability and poor scratch and dent resistance. The general increase in ductility at cryogenic temperatures demonstrated by aluminum and aluminum alloys is well known in the art. For example, data presented in the *Cryogenic Materials Data Handbook*—AFML—TDR—64-280, July 1970, show that the ductility of annealed aluminum and aluminum alloys, as measured by tensile elongation, is 50 to 100 percent higher at −196° C. than at 25° C. This behavior suggests that such materials would exhibit increased formability at −196° C. compared to 25° C., and U.S. Pat. No. 3,266,946 demonstrates that a 100 percent increase in tensile elongation at −196° C. compared to 25° C. results in a 100 percent increase in the achievable depth of undulation in a metal bellows fabricated from aluminum alloy sheet.

The present invention provides for the production of shaped articles of desired configuration from work-hardened sheets of aluminum and aluminum alloys by a forming operation wherein the sheet being shaped undergoes no fracture or tearing. Furthermore, shaped articles produced according to the present invention are characterized by improved resistance to surface scratching and denting and by substantially improved tensile strength which, in turn, allows for a higher load bearing capacity. The basis for these statements is the fact that the tensile elongation of such work-hardened aluminum and aluminum alloy sheet can be as much as 1000 percent higher at −196° C. than at 25° C. This is in contrast to the much smaller 50 to 100 percent increase in tensile elongation over the same temperature range demonstrated by annealed aluminum and aluminum alloys. Consequently, unexpectedly large increases in formability result from forming work-hardened aluminum and aluminum alloy sheet into shaped articles of desired configuration at cryogenic temperatures rather than at room temperature, allowing for their use in applications where increases in strength, scratch resistance and dent resistance of the shaped article are desirable. In addition, the present invention provides shaped articles having excellent surface characteristics which result from the suppression at cryogenic temperatures of the undesirable, discontinuous or serrated deformation characteristic of many aluminum alloys at room temperature. Thus, such shaped articles formed at cryogenic temperatures do not require a subsequent grinding or buffing operation in order to provide a smooth exterior surface.

According to the present invention, an improvement has been discovered in a method for cryogenically forming a sheet of aluminum or a solid solution strengthened aluminum alloy wherein the sheet has a maximum thickness of about 0.2 inch, said method comprising forming said sheet into a shaped article of desired configuration by deforming said sheet at a cryogenic temperature in the range of about minus 100° C. to about minus 200° C. The improvement comprises:

(a) work-hardening the sheet to at least about 25 percent of maximum hardness prior to the cryogenic deformation; and (b) conducting the cryogenic deformation in such a manner that (i) at least part of the sheet is deformed by tensile stresses, (ii) the thickness of said part is reduced by at least 2 percent by said deformation, and (iii) the smallest dimension of the area of the part to be deformed is at least equal to the thickness of the sheet.

Aluminum alloys are divided into two categories referred to as solid solution strengthened or precipitation hardened. Precipitation hardened aluminum alloys such as the 2000, 6000, or 7000 series do not demonstrate a large increase in formability at cryogenic temperatures compared to that demonstrated by solid solution strengthened aluminum alloys. Consequently, the present invention is intended to include pure aluminum and commercially pure aluminum such as the 1100 series of aluminum alloys, which will be referred to herein as "aluminum", and solid solution strengthened aluminum alloys such as the 3000, 4000, and 5000 series of aluminum alloys. The series of aluminum alloys are defined in "Aluminum Standards and Data 1976" published by the Aluminum Association Incorporated.

The term "sheet" as used herein is intended to encompass sheet which has a maximum thickness of about 0.2 inch, preferably a maximum thickness of about 0.05 inch.

Also, the term "work-hardening" as applied to aluminum sheet refers to aluminum sheet which has attained at least about 25 percent of the hardness resulting from subjecting annealed sheet to a 75 percent rolling reduction in the temperature range between ambient and about 49° C. Using the alloy designation system for aluminum alloys as found in "Aluminum Standards and Data 1976" referred to above, such work-hardened sheets are referred to as being in one of the group of tempers consisting of HX2, HX4, HX6, HX8, or HX9 where X can be the number 1, 2, or 3.

The metal sheets can be brought to the desired temperature within the range of about −100° C. to about −200° C. by immersing them in a suitable cryogenic medium such as liquid nitrogen or by a number of other well known methods such as the spraying of a cryogenic gas or liquid onto the metal sheets.

Forming operations with respect to the subject invention characterized as being "deformed by tensile stresses" refer to those types of processes wherein at least part of the sheet or all of the sheet is deformed as a result of a local stress field in which the largest stress component is tensile, said deformation resulting in a final thickness which is at least 2 percent less than the starting thickness. It is at such locations that premature failure is likely to initiate in attempting to form the shaped article. An example of an operation in which at least a part of the sheet is "deformed by tensile stresses" with resulting thinning is press-forming. In this process, the workpiece assumes the shape imposed by a punch and die and the applied forces may be tensile, compressive, bending, shearing or various combinations of these. However, the locations at which premature failure is likely to occur are those specific areas requiring large amounts of deformation and resultant reduction in thickness induced by a local stress field in which the largest stress is tensile. An example of an operation not involving a part "deformed by tensile stresses" would be coining. Coining is a closed-die squeezing operation in which all surfaces of the workpiece are confined or restrained and deformation is induced by a local stress field in which the largest stress is compressive. An example of an operation involving a part "deformed by tensile stresses," but not a substantial associated reduction in thickness, is bending. During bending, material on the outer bend radius is deformed under the action of tensile stress. However, the thickness in the vicinity of the bend undergoes an extremely small reduction in thickness, about 0.5 percent. Since the reduction in thickness during bending is negligible, bending operations such as press bending, press brake forming, and roll forming are not included in the scope of the present invention.

Additional examples of processes wherein forming of metal sheets into shaped structures often involves deformation under tensile stresses and resultant reduction in thickness are the following: deep drawing, stretch draw forming, rubber pad forming, hydrostatic forming, explosive forming, electromagnetic expansion, and the like.

In the following examples, which illustrate the present invention, test results are determined according to the following procedures:

Tensile Test: Percent elongation in two inches at the strain rate indicated (ASTM E8). The elongation values noted are the average values for both longitudinal and transverse orientations based on determinations relative to four test specimens.

Hydrostatic Bulge Test: Determination of the bulge height at failure and the percent biaxial strain at failure, The geometry of the hydrostatic bulge test specimens in a disc with a 6 inch diameter. However, the test fixture restricts the actual test section to a central 4 inch diameter section. Tests performed at a temperature of 25° C. are carried out using a simple hand-operated pump with water as the pressurizing medium. Bulge height and pressure are continually monitored throughout the tests. A Hewlett-Packard model 24 DCDT-3000 LVDT is used to measure the displacement of the center of the disc. A Dynisco model PT310B-10M pressure transducer is used to measure applied pressure. Maximum biaxial strains at failure are determined from a grid of intersecting 0.25 inch diameter circles, the grid being applied to each test specimen by photographic techniques. Tests performed at −196° C. are carried out using a cryogenic pumping apparatus with liquid nitrogen as the pressurizing medium. Test specimens are completely immersed in a bath of liquid nitrogen in order to insure a constant test temperature of −196° C. Bulge height is continually monitored with the same apparatus used in conducting the test at a temperature of 25° C. Bulge pressure is continually monitored by measuring the force applied to the piston of the cryogenic pump. The cross-sectional area of the piston is 1.29 square inches and the pressure is calculated by dividing the applied force by this area. Maximum biaxial strain at failure at −196° C. is measured as previously described.

EXAMPLE 1

This example is conducted using a work-hardened sheet of an aluminum clad 3003-H16 alloy having a thickness of 0.008 inch. A 3003-H16 alloy is a solid solution strengthened aluminum alloy containing 1.2 percent by weight manganese as a major alloying element. The alloy has been cold rolled at room temperature to 75 percent of maximum hardness. The surface of the sheet is clad with a 0.0004 inch thick layer of 7072 aluminum alloy containing 1.0 percent zinc.

Test specimens are brought to the temperatures and subjected to the tensile test at the temperatures and at the strain rate indicated.

It is determined that, at the location of application of the tensile stresses, the thickness is reduced by at least 2 percent by such application and the smallest dimension of the area at that location is at least equal to the thickness of the sheet.

| | Temperature | Elongation in 2 Inches (Percent) (Strain Rate = $5 \times 10^{-4}$ $sec^{-1}$) |
|---|---|---|
| Test Specimen 1 (Test specimen immersed in nitrogen) | −196° C. | 20.7 |
| Test Specimen 2 (Test specimen immersed in a mixture of dry ice and alcohol | −79° C. | 3.6 |
| Test Specimen 3 | +25° C. | 1.5 |

EXAMPLE 2

This example is conducted, according to the procedures described in Example 1, using a 1100-H18 alloy sheet having a thickness of 0.007 inch. A 1100-H18 alloy is 99 percent by weight pure aluminum which has been cold rolled at room temperature to maximum hardness.

This example demonstrates that advantages associated with cryogenic forming, in accordance with the present invention, are realized in operations with characteristically high rates of deformation, that is, conducting the tensile test at a strain rate of 3.6 $sec^{-1}$.

| | Temperature | Elongation In 2 Inches (Percent) (Strain Rate= $5 \times 10^{-4}$ $sec^{-1}$) | Elongation In 2 Inches (Percent) (Strain Rate= 3.6 $sec^{-1}$) |
|---|---|---|---|
| Test Specimen 4 | −196° C. | 28.0 | 22.5 |
| Test Specimen 5 | −79° C. | 2.8 | — |

-continued

| | Temperature | Elongation In 2 Inches (Percent) (Strain Rate= $5 \times 10^{-4}$ $sec^{-1}$) | Elongation In 2 Inches (Percent) (Strain Rate= 3.6 $sec^{-1}$) |
|---|---|---|---|
| Test Specimen 6 | +25° C. | 2.0 | — |

EXAMPLE 3

This example is conducted using the metal sheet described in Example 2.

Test specimens are brought to the temperatures indicated and subjected to the hydrostatic bulge test at these temperatures.

| | Temperature | Bulge Height At Failure | Biaxial Strain At Failure (Percent) |
|---|---|---|---|
| Test Specimen 7 | −196° C. | 0.93 inch | 21.9 |
| Test Specimen 8 | +25° C. | 0.58 inch | 9.6 |

EXAMPLE 4

This example is conducted using the metal sheet described in Example 2.

Test specimens are brought to the temperatures indicated and subjected to the hydrostatic bulge test.

| | Temperature | Bulge Height At Failure | Biaxial Strain At Failure (Percent) |
|---|---|---|---|
| Test Specimen 9 | −196° C. | 0.68 inch | 11.6 |
| Test Specimen 10 | +25° C. | 0.4 inch | 5.1 |

We claim:

1. In a method for cryogenically forming a sheet of aluminum or a solid solution strengthened aluminum alloy wherein the sheet has a maximum thickness of about 0.2 inch, said method comprising forming said sheet into a shaped article of desired configuration by deforming said sheet at a cryogenic temperature in the range of about minus 100° C. to about minus 200° C., the improvement comprising:

(a) work-hardening the sheet to at least about 25 percent of maximum hardness prior to the cryogenic deformation; and (b) conducting the cryogenic deformation in such a manner that (i) at least part of the sheet is deformed by tensile stresses, (ii) the thickness of said part is reduced by at least 2 percent by said deformation, and (iii) the smallest dimension of the area of the part to be deformed is at least equal to the thickness of the sheet.

2. The method defined in claim 1 wherein the sheet is work-hardened to at least about 75 percent of maximum hardness.

3. The method defined in claim 2 wherein the maximum thickness is about 0.05 inch.

* * * * *